US006061049A

United States Patent [19]

Pettitt et al.

[11] Patent Number: 6,061,049

[45] Date of Patent: May 9, 2000

[54] NON-BINARY PULSE-WIDTH MODULATION FOR IMPROVED BRIGHTNESS

[75] Inventors: Gregory S. Pettitt, Rowlett, Tex.; Gregory J. Hewlett, North Wales, Pa.; Vishal Markandey, Dallas, Tex.

[73] Assignee: Texas Instruments Incorporated, Dallas, Tex.

[21] Appl. No.: 09/136,838

[22] Filed: Aug. 20, 1998

Related U.S. Application Data

[60] Provisional application No. 60/057,553, Aug. 29, 1997.

[51] Int. Cl.[7] ..... G09G 5/10

[52] U.S. Cl. ..... 345/148; 348/771

[58] Field of Search ..... 348/771; 345/148, 345/147, 89, 149, 155, 84

[56] References Cited

U.S. PATENT DOCUMENTS

| | | | |
|---|---|---|---|
| 5,510,824 | 4/1996 | Nelson | 347/239 |
| 5,619,228 | 4/1997 | Doherty | 345/148 |

FOREIGN PATENT DOCUMENTS

| | | | |
|---|---|---|---|
| 0 686 954 A1 | 12/1995 | European Pat. Off. | G09G 3/34 |
| 0 689 345 A2 | 12/1995 | European Pat. Off. . | |
| 0 749 248 A1 | 12/1996 | European Pat. Off. . | |
| WO 92/12506 | 7/1992 | WIPO . | |
| WO 96/41326 | 12/1996 | WIPO . | |

*Primary Examiner*—Andrew I. Faile
*Assistant Examiner*—Sam Huang
*Attorney, Agent, or Firm*—Charles A. Brill; Frederick J. Telecky, Jr.; Richard L. Donaldson

[57] ABSTRACT

A method of increasing the brightness of a pulse width modulation display system. Image bits are displayed during display periods having a non-binary relationship. The display period of an object bit 902 is set equal to a minimum data load time, and the display periods of all other bits are initially set to have a binary relationship with the object bit. The display periods of at least one non-object bit 904, 906, 908 are then reduced in order to reduce the total frame time to no more than the available useable frame time 910. Preferably, only the display periods of bit of significance greater than the object bit are reduced. The reduction of display periods is guided by Weber's law, in order to prevent the non-binary steps from being noticeable or objectionable to the viewer.

14 Claims, 7 Drawing Sheets

NON-BINARY PULSE-WIDTH MODULATION FOR IMPROVED BRIGHTNESS

This application claims priority under 35 U.S.C. § 119 (c) (1) of provisional application number 60/057,553 filed Aug. 29,1997.

FIELD OF THE INVENTION

This invention relates to the field of image display systems, more particularly to image displays using pulse-width modulation to produce gray-scale images.

BACKGROUND OF THE INVENTION

Image display systems create images by emitting or modulating light. The light forms an array of picture elements, or pixels, which together form a viewable image. While most light modulators can create multiple intensity levels, true digital light modulators, such as the Digital Micromirror Device (DMD) cannot. Without the capability to create multiple brightness levels, digital light modulators rely on a binary pulse width modulation scheme to create various intensity levels by turning a modulator element on and off very rapidly. This modulation scheme, however, can create inefficiencies which lower the intensity of the displayed image.

Intensity, or image brightness, is only one of many metrics, including horizontal and vertical resolution, color purity, display size, frame rate, and immunity from device created image artifacts, by which display systems are judged. Some of these characteristics are more important to consumers, either because they create a noticeably superior image, or simply because they differentiate between the display systems on display in a store. Brightness is one metric that is extremely important to purchasers of display systems. Therefore, an improved modulation scheme and system are needed to increase the image brightness available in pulse width modulated display systems.

SUMMARY OF THE INVENTION

Objects and advantages will be obvious, and will in part appear hereinafter and will be accomplished by the present invention which provides a method and system for a non-binary pulse width modulated display having improved brightness.

According to one embodiment of the present invention, a method of increasing the brightness of a display system is provided in which a useable frame period is divided into non-binary bit periods, one bit period for each of n image bits. According to this embodiment, an object bit is determined, the object bit being the bit having the largest binary bit display period which is less than a minimum data load time of a target display device. The display period of the object bit is set equal to the minimum data load time of the display device, and the periods of all other image bits are set to have a binary relationship to the display period of the object bit. The display period of at least one non-object bit is then reduced so that the sum of all display periods and any necessary blanking periods is no greater than the useable frame time of the display system.

According to another embodiment, the reduction in non-object bit display periods is performed to reduce the perceptible impact on the displayed image. Ideally, the reduction results in a Weber's fraction of less than 11%, or more preferably less than 6%, or still more preferably less than 2%, or most preferably Weber's fraction is minimized for all transitions of the reduced bits.

According to another embodiment of the disclosed system, a display system having increased brightness is provided. The display system comprises, a display device having a minimum data load time and a timing and control circuit. The timing and control circuit for receiving image data words comprised of data bits including an object bit, and for providing the data bits to the display device for display during bit periods having a length. The object bit has a bit period at least equal to the minimum data load time, and the length of bit periods for data bits of significance less than the object bit have a binary relationship to the length of the object bit display period. The display period for data bits of significance greater than the object bit have a shortened, non-binary relationship to the object bit.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
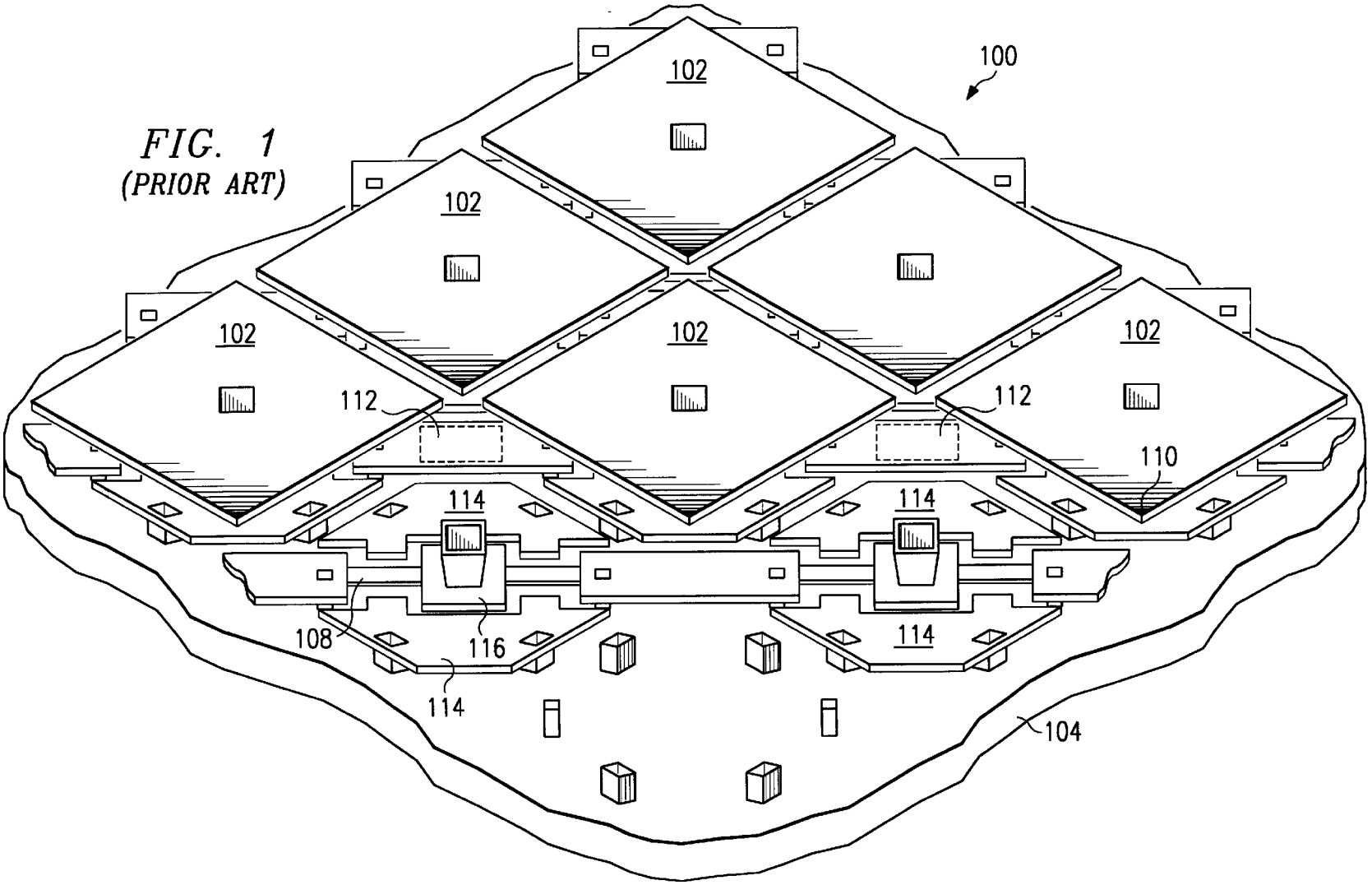
FIG. 1 (PRIOR ART)
FIG. 1 is a perspective view of a portion of a Digital Micromirror Device (DMD) array of the prior art.
Figure 2:
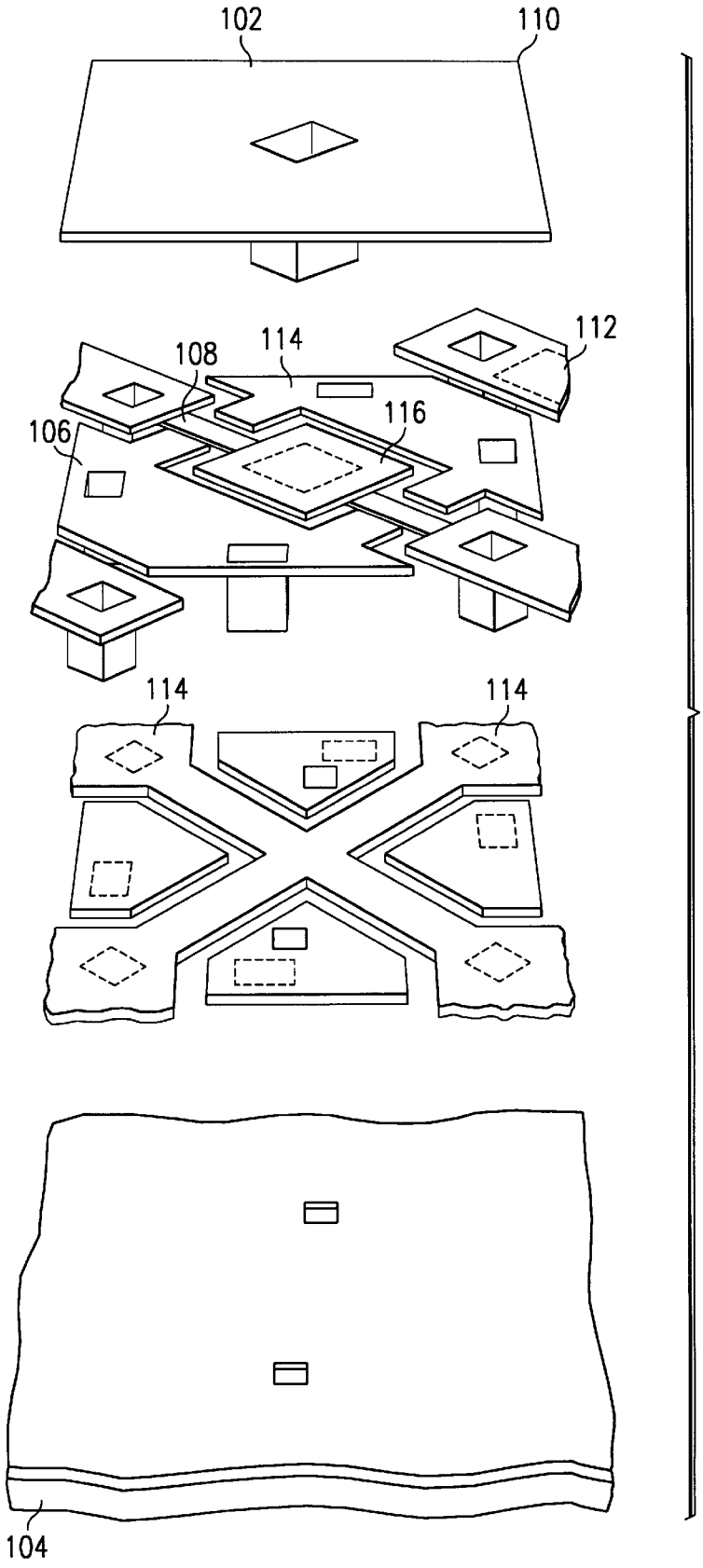
FIG. 2 (PRIOR ART)
FIG. 2 is an exploded view of the DMD of FIG. 1.

A promising technology which may dramatically improve the image quality of image displays is the Digital Micromirror Devices (DMD). FIGS. 1 and 2 show a portion of a typical DMD array 100. A DMD is an array of very small mirror elements 102 suspended over a substrate 104 which are operable to modulate incident light. Electrostatic attraction between the mirror 102 and an address electrode 106 causes the mirror to twist, in either of two directions, about an axis formed by a torsion beam hinge 108. The mirror rotates about this hinge until the rotation is mechanically stopped. Some DMD designs stop the rotation by landing the tip 110 of the mirror 102 on a landing zone 112, other designs use an elongated yoke which contacts a bias/reset metalization layer on the surface of the substrate. The yoke 116 shown in FIGS. 1 and 2 is not elongated since the mirror 102 shown lands on the tip 110 rather than the yoke.

DMDs are controlled by electronic circuitry fabricated on the silicon substrate 104 under the DMD array. The circuitry includes an array of memory cells, typically one memory cell for each DMD element, connected to the address electrodes 106. The output of a memory cell is connected to one of the two address electrodes and the inverted output of a memory cell is connected to the other address electrode. Once data is written to each memory cell in the array, a voltage is applied to the DMD mirrors 102 creating a large enough voltage differential between the mirrors and the address electrodes to cause the mirror to rotate in the direction of the greatest voltage potential. Since the electrostatic attraction grows much stronger as the mirror is rotated near an address electrode, the memory cell contents may be changed without altering the position of the mirrors once the mirrors are fully rotated. Thus, the memory cells may be loaded with new data while the array is displaying previous data. A typical load time for a DMD array is 219.8 $\mu$S, but the load time varies depending on the input circuitry used by a particular DMD array.

Figure 3:
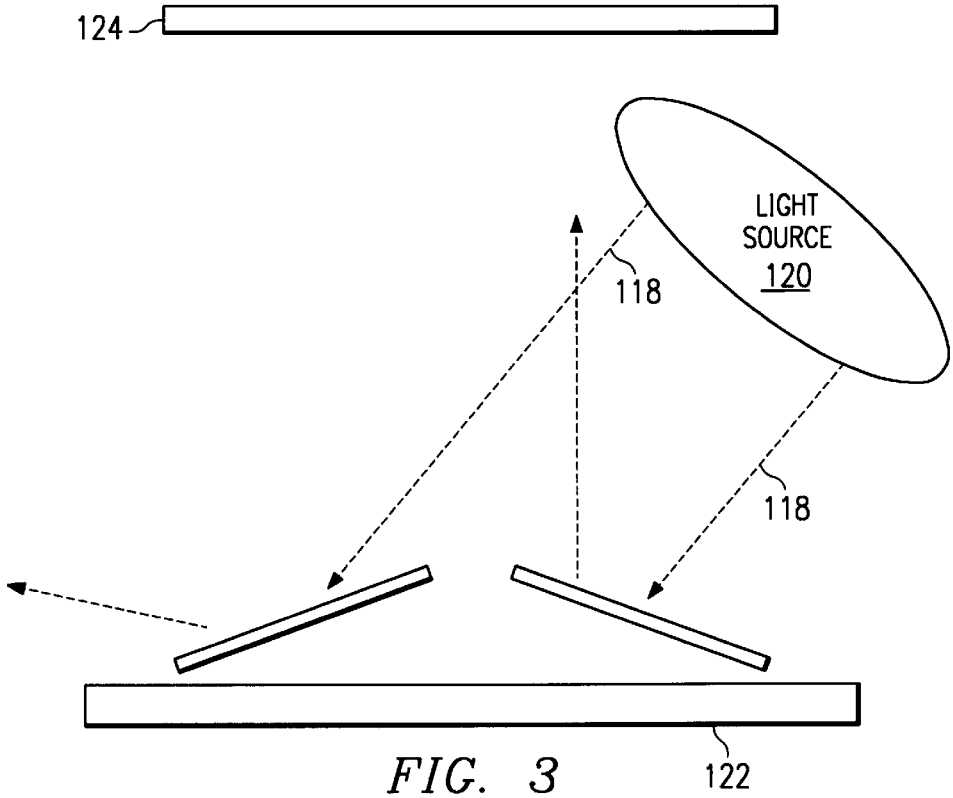
FIG. 3 (PRIOR ART)
FIG. 3 is schematic representation of the bistable operation of two mirrors of the DMD array of FIG. 1.

DMD arrays are typically operated in a dark-field mode. In one embodiment of dark-field operation, shown in FIG. 3, light 118 from a light source 120 is focused on a DMD array 122 and strikes the DMD array 122 from an angle equal to twice the angle of rotation. If a mirror 102 is rotated towards the light source 120, rotated to an "on" position, light incident the mirror will reflect perpendicular to the array and may be focused on a viewing screen 124 or image plane where it will form part of the image. If a mirror 102 is rotated away from the light source 120, rotated to an "off" position, light incident the mirror 102 will reflect away from the viewing screen 124 and will not form part of the image.

Light incident the DMD forms an illuminated dot on the viewing screen for every mirror 102 that is rotated to the on position. Each of these dots represents one picture element, or pixel, which is the smallest individually controllable portion of an image. Using a large array of mirrors, an image is created by selectively turning some mirrors to the on position while turning some to the off position, thereby creating a pattern of illuminated dots on the viewing screen.

To create multiple brightness levels, or shades of gray, the duty cycle of each mirror is altered by rapidly rotating the mirror on and off. This creates a pixel that, over time, consists of a series of illuminated periods and non-illuminated periods. The viewer's eye integrates these periods so that the view perceives an illuminated dot having a brightness proportional to the duty cycle of the mirror.

Figure 4:
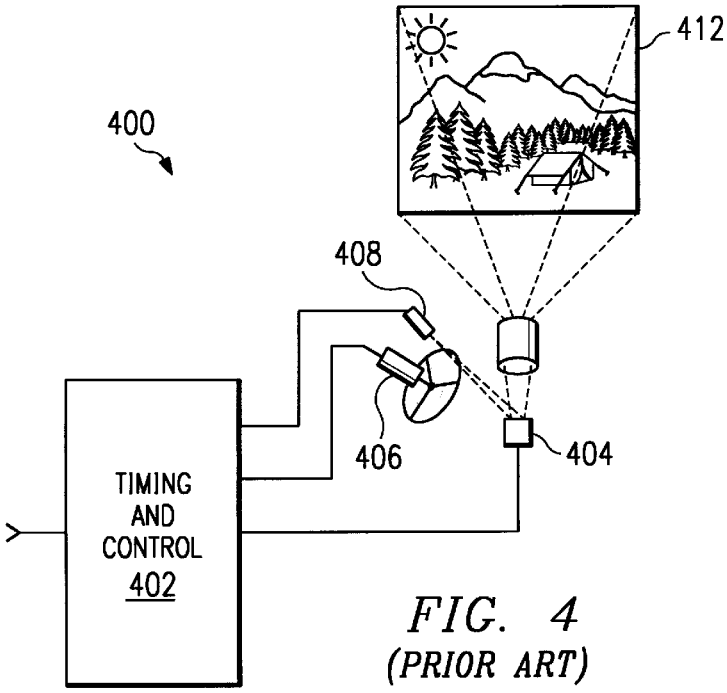
FIG. 4 (PRIOR ART)
FIG. 4 is a schematic representation of a DMD-based image display system of the prior art.

Full-color images are created by displaying multiple monochromatic images, typically red, green, and blue, and once again allowing the viewers eye to integrate a series of images. Depending on the cost and required image quality of the projection system, the monochromatic images may be projected sequentially or simultaneously. FIG. 4 depicts a sequential color DMD-based image projector 400. Timing and control circuit 402 receives image data from a tuner or other image source, and controls the operation of a DMD 404, a color wheel motor 406 and a light source 408. A projector lens 410 focuses light from the DMD 404 onto a viewing surface 412 where the modulated light creates a full-color image.

Figure 5:
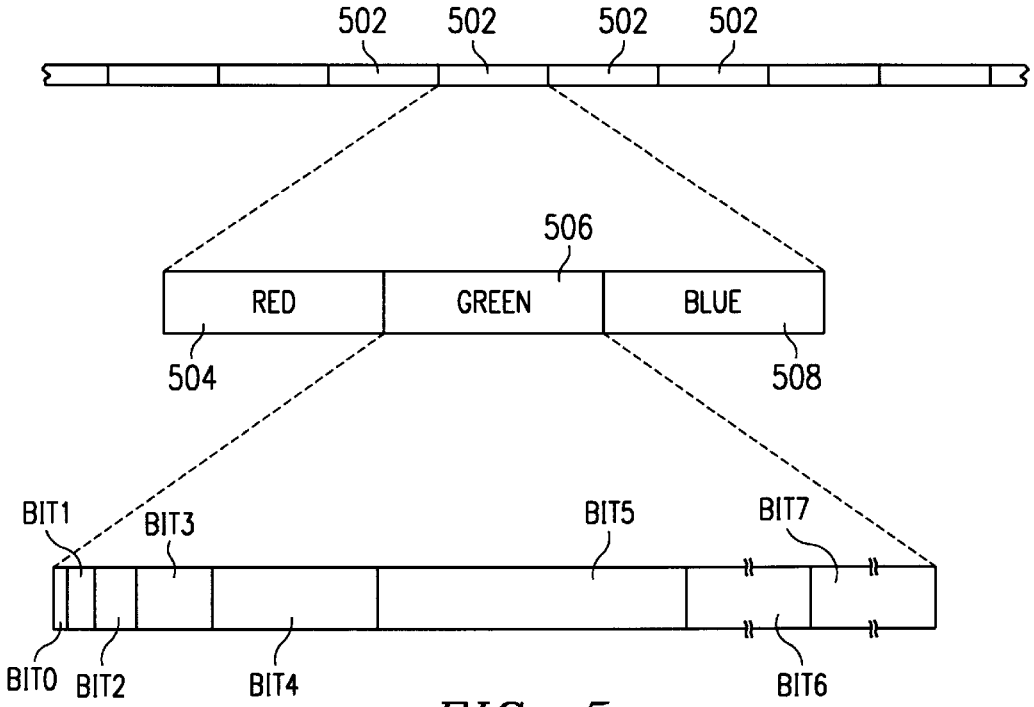
FIG. 5 (PRIOR ART)
FIG. 5 is a timeline showing a simplified representation of the subdivision of display periods used by the display system of FIG. 4.

FIG. 5 is a timeline showing a typical sequential color binary pulse-width modulation data stream. In FIG. 5, each frame period 502 is comprised of three sub-frames 504, 506, 508, each sub-frame being a period in which the color wheel outputs monochromatic light. Each sub-frame is further subdivided into bit periods. During each bit period the DMD mirrors are set to the on or off position depending on the image data written into the DMD by the timing and control circuit 402. FIG. 5 shows a simple bit sequence for one binary 8-bit color word of a three color image system in which each bit is displayed for twice the period of the less-significant prior bit. FIG. 5 is for illustration only, some applications alter the order in which the bits are displayed, or even divide the longer bit periods into two shorter, non-consecutive bit periods. Furthermore, some systems split one or more of the color sub-frames such that some of the data bits are displayed during one sub-frame while others are displayed in another sub-frame.

Figure 6:
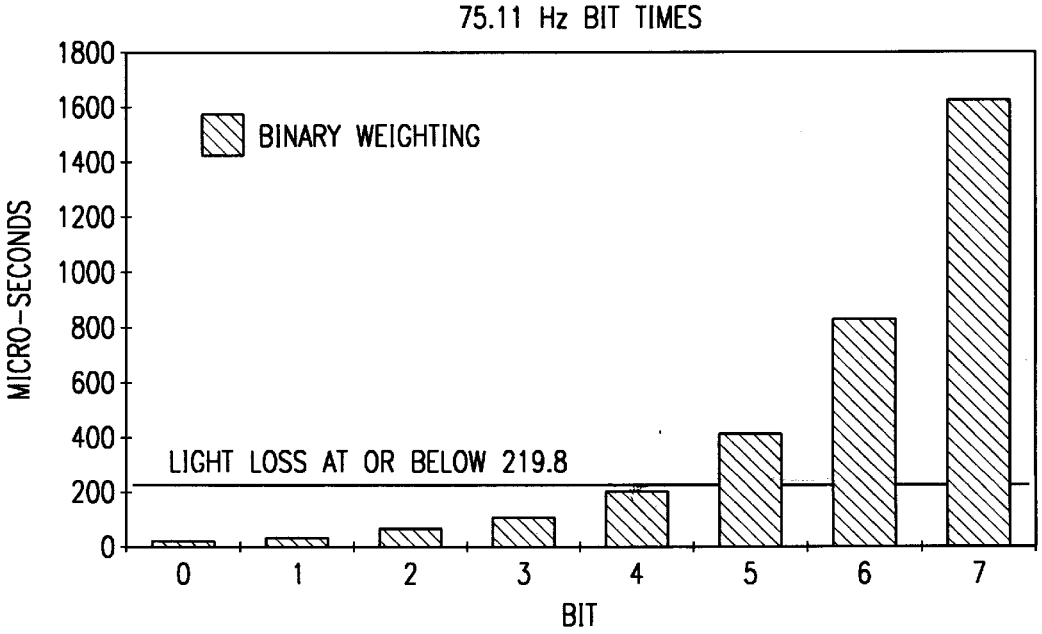
FIG. 6 (PRIOR ART)
FIG. 6 is a graph of the display period duration for binary weighted data bits.

FIG. 6 shows the display period for each bit of an 8-bit binary image data word in a three color image display system operating at a 75.11 Hz frame rate. As mentioned above, a typical DMD array takes 219.8 $\mu$S to transfer image data for each pixel into the memory array controlling the mirror operations. As seen in FIG. 6, five of the eight data bits, bits 0–4, are displayed for less than 219.8 $\mu$S. When a bit is displayed for less than the load time, the display data for the next display period cannot be loaded into the memory array before the end of the bit display period, and a blanking period must be used.

Figure 7:
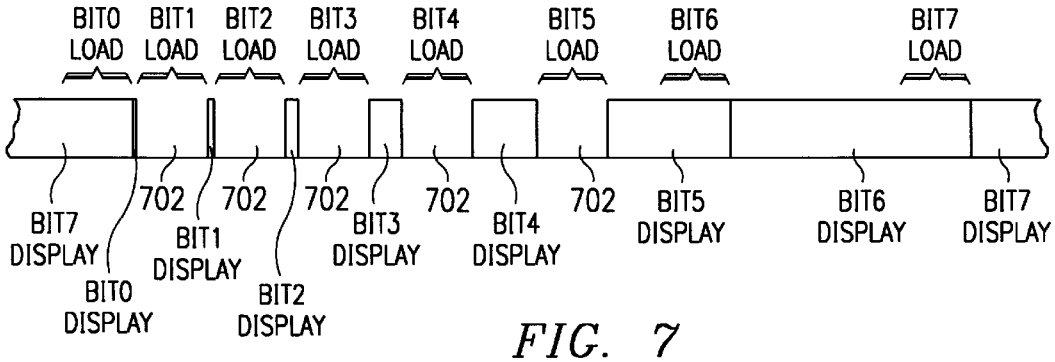
FIG. 7 (PRIOR ART)
FIG. 7 is a timeline of a frame period showing the blanking periods necessary to load data into a display device following short data periods.
Figure 8:
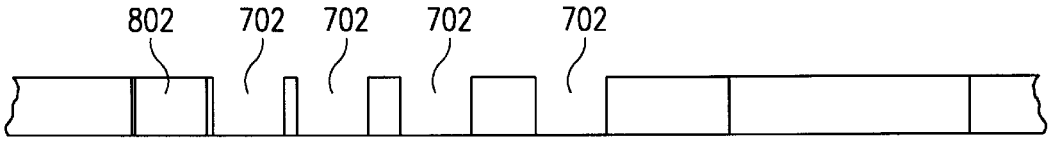
FIG. 8 (PRIOR ART)
FIG. 8 is a timeline of a frame period showing one of the blanking periods of FIG. 7 converted to a bit set period in order to increase brightness.

Blanking periods 702, as shown in FIG. 7, are periods during which all of the mirrors on the array are in the off position while the memory array is being loaded. Blanking periods are at least as long as the period necessary to load the imaging device. Some imaging devices may simply be turned off, or powered down, during blanking periods. Removing the bias voltage from the DMD mirrors, however, returns the mirrors 102 to a neutral position where at least some reflected light enters the lens aperture and is projected onto the viewing surface. Therefore, all of the DMD mirrors must be rotated to the off position during blanking periods.

Rotating all of the DMD mirrors to the off position requires writing data to each memory cell in the DMD. Since writing "off" data to a memory cell takes the same amount of time that writing image data takes, and since blanking periods are necessary when there is insufficient time to write image data to the memory cells, additional circuitry is added to the DMD to allow "off" data to be written to all of the memory cells, or large blocks of the memory cells. This additional circuitry fills the entire DMD array with "off" data during even the smallest bit display periods.

While blanking periods allow display devices to operate at high frame rates or at finely adjusted gray scales, they reduce maximum brightness of the resulting image. The brightness reduction is due to the fact that the portions of the light beam received by the DMD during the blanking periods are not used to create an image.

Image brightness is very important to consumers of video displays. Thus, any reduction in the brightness of a display reduces consumer satisfaction and results in lost sales opportunities. Therefore, it is highly advantageous to increase the brightness of a display, even through means that reduce the fidelity of the displayed image.

One method of increasing the brightness of the display is to change one or more blanking periods from an all "off" period to an all "on" period: a period during which all of the mirrors reflect light to the viewing screen. Although this method does increase the brightness of the display, it also reduces the contrast ratio of the display. A better method is to adjust the bit display periods to efficiently utilize the frame period. Specifically, a better method is to minimize the number of blanking periods required by lengthening the display period for one or more bits in order to eliminate the need for the blanking period previously required after the now lengthened bit.

The benefits achieved, and the impact to an image, from lengthening the display period of a bit greatly depends on the amount the display period must be lengthened in order to eliminate a blanking period. The closer a bit display period is to the minimum data load period of the display device, the less a bit display period must be extended to eliminate a blanking period and the greater the benefit from lengthening the bit. The more a bit display period must be extended, the smaller the benefit from lengthening the bit and the more objectionable the resulting changes to the image will be.

Lengthening a bit period was found to increase image brightness without introducing objectionable side effects in sequential color systems operating at a 72 to 78 Hz frame rate. At a 75 Hz frame rate, a single color frame period is 4444 $\mu$S long. The display system cannot operate during a transition between segments on the color wheel since any image produced during a color transition, or spoke time, would not only be two colors, but the dividing point between the two single color regions would be moving. Therefore, during color transitions, which typically take 272.2 $\mu$S, the mirrors on the DMD must be rotated to the off position so that light incident the display device is not allowed to reach the viewing screen.

This color transition blanking period is synchronized with the device load blanking period so that one blanking period coincides with the spoke time, thereby minimizing the total time the display device is inoperative. Since there is no need for a blanking period immediately following bit 7, aligning the color transition with a spoke requires the data bits to be displayed in some order other than by increasing significance as shown in FIG. 7. Nevertheless, for the purposes of illustration, this disclosure will ignore spoke periods and illustrate the disclosed invention using only sequential bit sequences.

The length of the typical spoke time, 272.2 $\mu$S, is greater than the typical minimum blanking period, 219.8 $\mu$S, so the blanking period coinciding with the spoke time is increased. Additionally, a mirror control process called reset release also extends the length of one blanking period to 272.2 $\mu$S.

Dividing the useable frame period into eight binary bit periods requires the use of five blanking periods as shown in FIG. 7. Each blanking period is equal to the minimum load time of the display device, in this case 219.8 $\mu$S, or the duration of the color wheel spoke period. The approximate bit periods for each bit are listed below in Table 1. As seen in FIG. 7 and Table 1, 1203.8 $\mu$S are used solely for the five blanking periods, leaving only 3240.2 $\mu$S during which to display image data. Also shown in FIG. 7 and Table 1, the display period for bit 4 is 195.2 $\mu$S, just short of the minimum 219.8 $\mu$S minimum load time.

TABLE 1

| Bit | Duration |
|---|---|
| Bit 0 | 12.2 $\mu$S |
| Blanking Period 0 | 272.2 |
| Bit 1 | 24.4 |

TABLE 1-continued

| Bit | Duration |
|---|---|
| Blanking Period 1 | 272.2 |
| Bit 2 | 48.8 |
| Blanking Period 2 | 219.8 |
| Bit 3 | 97.6 |
| Blanking Period 3 | 219.8 |
| Bit 4 | 195.2 |
| Blanking Period 4 | 219.8 |
| Bit 5 | 390.3 |
| Bit 6 | 780.6 |
| Bit 7 | 1561.2 |
| Total Bit Period | 3110.3 $\mu$S |
| Total Blank Period | 1203.8 $\mu$S |
| Total Frame Period | 4314.1 $\mu$S |

Table 2 details the timing for a single color frame period of the same length as Table 1, illustrating some of the features of the present invention. The bit periods for bits 0–7 utilize binary weighting as did the bits in Table 1, but are derived by setting bit 4 equal to the minimum device load time, and calculating the display periods for all other bits based on the length of bit 4. The lengthened bit, herein referred to as the "object bit," is the bit having the longest display period which is less than the minimum load time of the display device. The object bit could be any bit in the display word: depending on the minimum data load time of the display device, the number of data bits, and the useable frame time of the display.

TABLE 2

| Bit | Duration |
|---|---|
| Bit 0 | 13.7 $\mu$S |
| Blanking Period 0 | 272.2 |
| Bit 1 | 27.5 |
| Blanking Period 1 | 272.2 |
| Bit 2 | 55.0 |
| Blanking Period 2 | 219.8 |
| Bit 3 | 109.9 |
| Blanking Period 3 | 219.8 |
| Bit 4 | 219.8 |
| Bit 5 | 439.6 |
| Bit 6 | 879.2 |
| Bit 7 | 1758.4 |
| Total Bit Period | 3503.1 $\mu$S |
| Total Blank Period | 984.0 $\mu$S |
| Total Frame Period | 4487.1 $\mu$S |

While the binary timing allocation of Table 2 increases the efficiency of the display system by reducing the total time allocated to blanking periods to 984 $\mu$S from 1203.8 $\mu$S, the total time used to display all eight bits, 4487.1 $\mu$S, exceeds the 4444 $\mu$S available, hence the need for the shorter binary bit times of Table 1. By foregoing purely binary bit periods, however, the benefit of the lengthened bit, i.e. increased brightness, is maintained without exceeding the allowable bit display period.

Figure 9:
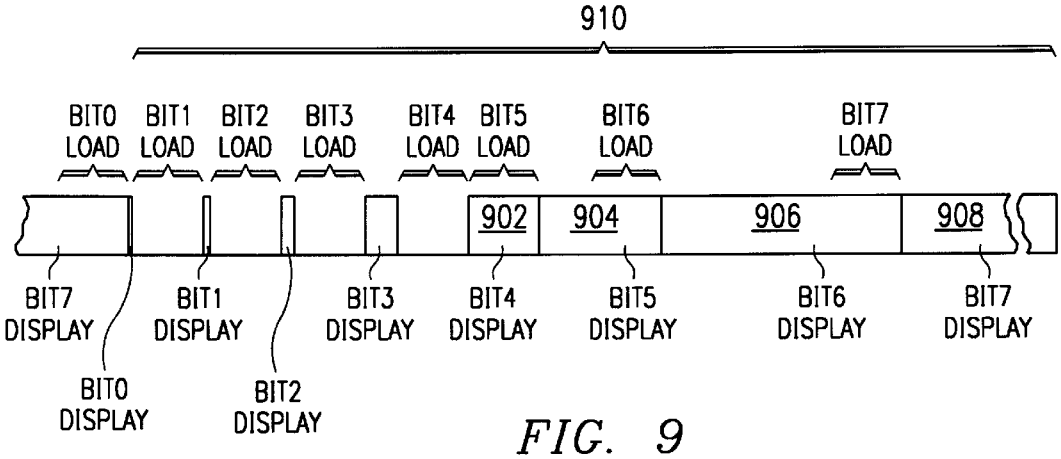
FIG. 9 is a timeline of a frame period showing non-binary bit weighting according to one embodiment of the present invention.
Figure 10:
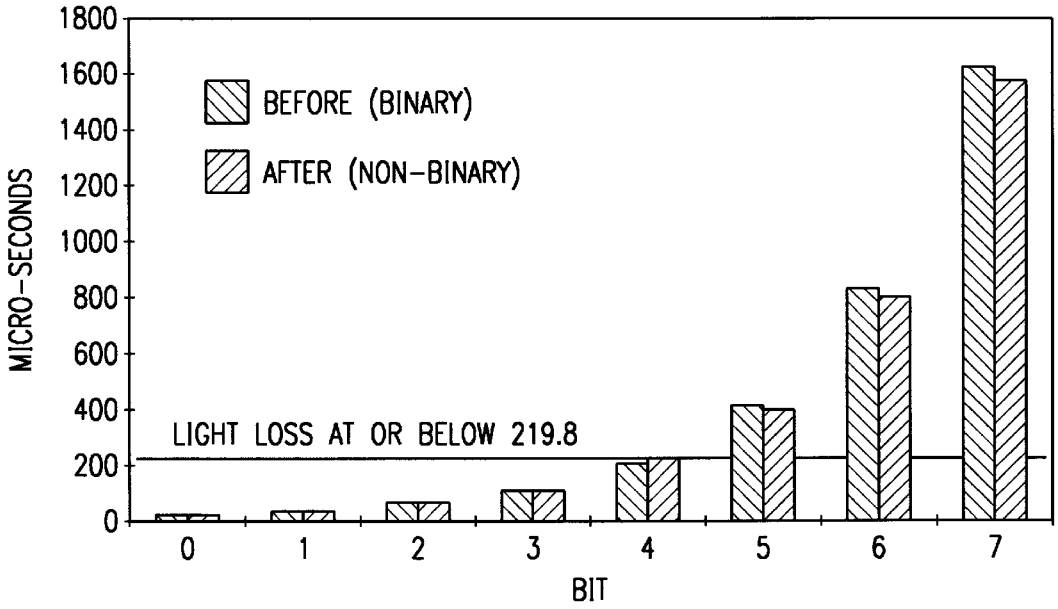
FIG. 10 is a graph of the display period duration for binary weighted and non-binary weighted data bits.
Figure 11:
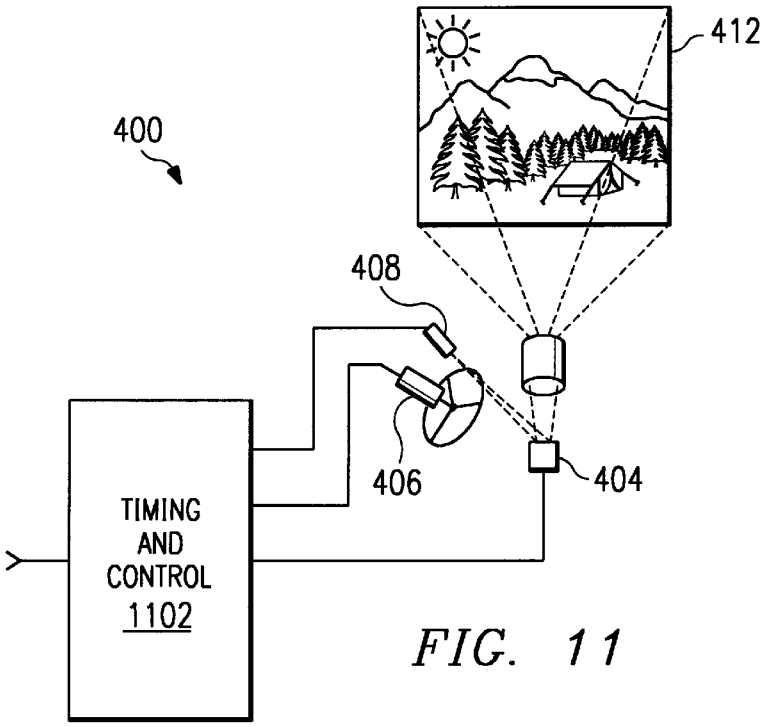
FIG. 11 is a schematic representation of a DMD-based display system providing improved brightness by the elimination of a blanking period.

Table 3 and FIGS. 9 and 10 illustrate one embodiment of the disclosed invention. In Table 3, bit 4 has been set equal to the minimum data load time for the display device, and the rest of the data bit display periods have been set to provide a binary weighing between bits 0–4. Bits 5–7 have been set to a length that closely approximates a binary relationship with the object bit, but is slightly shorter so that all for the bit periods and blanking periods are less than the useable frame time. As a result of altering the bit weighting from true binary weighting to a weighting scheme that eliminates a blanking period, the sum of all bit periods has increased from 3110.4 μS to 3330.4 μS, which translates to an increase in brightness of 7.1%. FIG. 9 is a timeline of a frame period 910 showing an elongated object bit display period 902 and shortened display periods for the data bits of significance greater than the object bit 904, 906, 908. FIG. 10 is a graph of the bit display periods for each data bit of a binary display system and a non-binary display system according to one embodiment of the present invention. FIG. 11 is a schematic representation of a DMD-based display system providing improved brightness by the elimination of a blanking period.

TABLE 3

| Bit | Duration |
|---|---|
| Bit 0 | 13.7 μS |
| Blanking Period 0 | 272.2 |
| Bit 1 | 27.5 |
| Blanking Period 1 | 272.2 |
| Bit 2 | 55.0 |
| Blanking Period 2 | 219.8 |
| Bit 3 | 109.9 |
| Blanking Period 3 | 219.8 |
| Bit 4 | 219.8 |
| Bit 5 | 425.4 |
| Bit 6 | 869.5 |
| Bit 7 | 1748.4 |
| Total Bit Period | 3330.4 μS |
| Total Blank Period | 984.0 μS |
| Total Frame Period | 4314.4 μS |

The weighting scheme discussed above substantially increases the brightness of the image display system, but it does so by disrupting the binary weighting with which the data was originally encoded. This disruption raises two issues which are sources of artifacts, or image attributes created by the display system that are not present in the input image data. The first issue is that an image display using the non-binary weighting will not perfectly reproduce the original brightness levels represented by the binary weighted image data.

The second issue is whether the non-binary bit weights will cause large luminance steps between adjacent data values. Ideally, a display system is capable of producing enough unique luminance levels that the difference between two adjacent levels is imperceptible to the human viewer.

Large luminance steps introduce image artifacts in the image display. Specifically, since the pixel duty cycle has odd-sized jumps when any image bits with non-binary weighting transition from one state to another, the image display system introduces false contours in the displayed image.

Although the potential image artifacts cannot be eliminated, their impact is reduced, often below the level perceptible to the human eye, by careful selection of the non-binary bit periods. Whether a change in luminance, or brightness, is perceptible to the human eye is described by Weber's Law. From the Television Engineering Handbook:

> If an area of luminance B is viewed side by side with an area of luminance B+AB, a value ΔB may be established for which the brightness of the two areas are just noticeably different. The ratio of ΔB/B is known as Weber's fraction. The statement that this ratio is a constant, independent of B, is known as Weber's Law.

Prior to computing Weber's fraction, the response curve of the display must be scaled to account for the contrast ratio of the display system. To compensate for the contrast ratio, the brightest intensity level is normalized to a value of 1.0 and all other intensity levels are set according to:

$$B[n]=\Gamma^{-1}[n]^{*}\ (CR-1)+1)/CR$$

where: B[n]=normalized brightness output (0, 1.0) $\Gamma^{-1}[n]$= output level of de-gamma lookup table (0, 1.0) CR=contrast ratio as CR:1

Although Weber's Law breaks down at very high and very low luminance levels, Weber's Fraction over the range of interest for most consumer display systems is relatively constant at approximately 2%. Therefore, as long as the non-binary steps result in a change of brightness less than 2%, the step should be imperceptible to a human viewer and no visible artifacts will be introduced into the image. Steps of more than 2%, but less than 6%, are just noticeable. Steps of over 6%, but less than 11%, are noticeable, but acceptable for many applications, while steps of over 11% are objectionable and therefore unacceptable due to the effects of false contouring.

Figure 12:
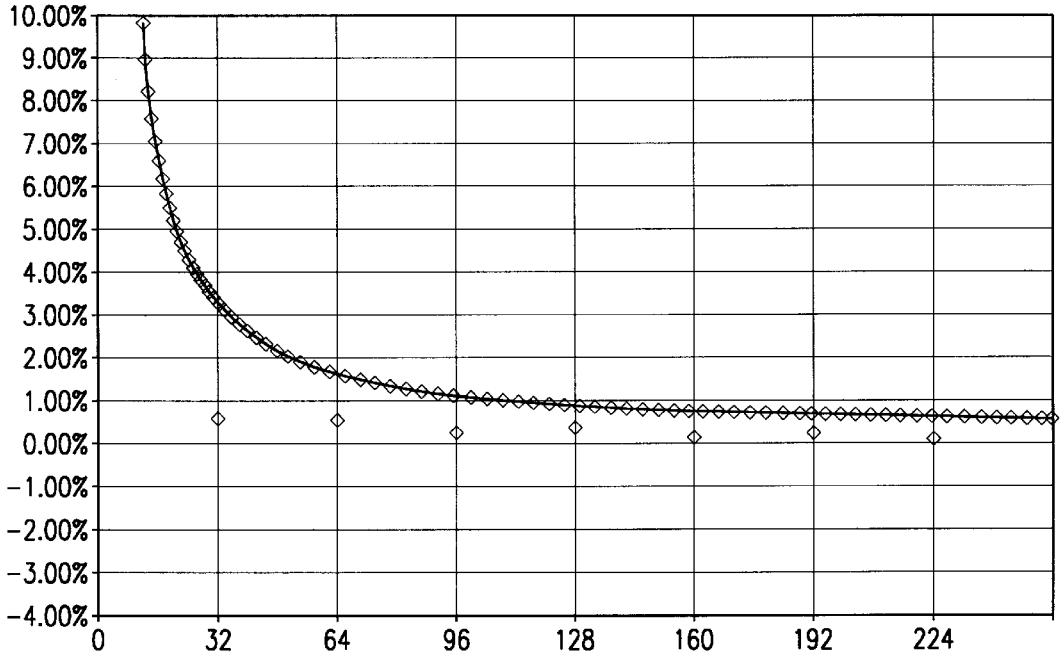
FIG. 12 is a graph showing the impact of non-binary weighted data on a green image sub-frame display period at a 75.11 Hz. frame rate.
Figure 13:
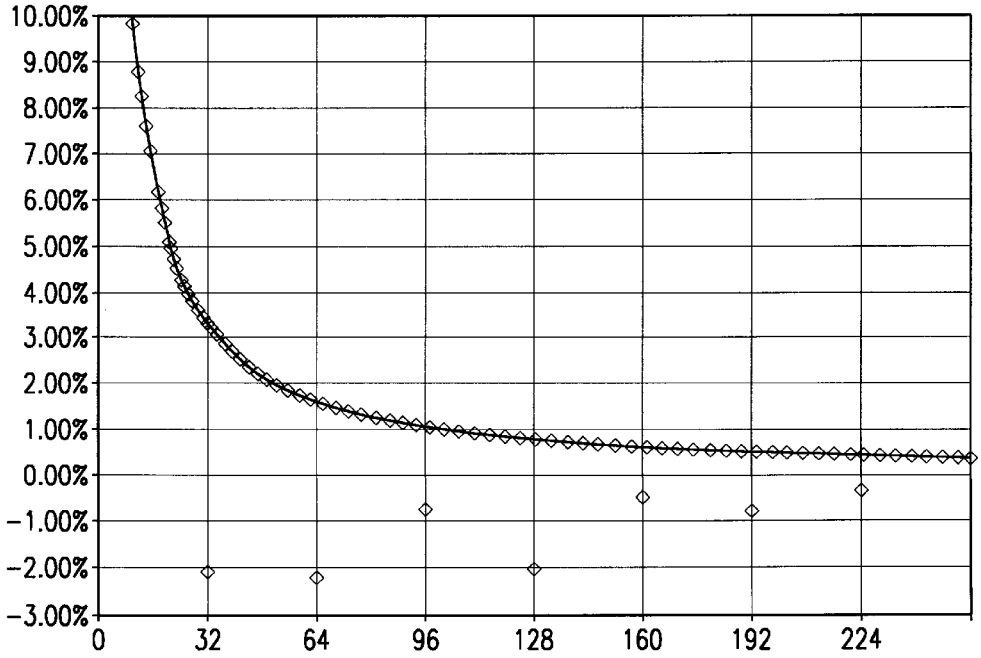
FIG. 13 is a graph showing the impact of non-binary weighted data on a red image sub-frame display period at a 75.11 Hz. frame rate.

Because Weber's law indicates when luminance steps will become noticeable, it provides a useful metric with which to determine how to reduce the display periods so that the total display period is no greater than the useable frame period. FIGS. 12 and 13 show Weber's fraction plotted against the input data word for one embodiment of the disclosed invention. Although any of the non-object bits could be reduced to compensate for the lengthened bits, in practice only the bits of significance greater than the object bit are reduced. Reducing only the most significant bits limits the disruption of original Weber's fraction to fewer locations since the larger bits toggle less than the smaller data bits over the range. Although Weber's fraction at the low end of the image data scale is high even with true binary weighting, preferably Weber's fraction is limited to less than +/−11% for the range of values greater than the weight of the object bit. More preferably, Weber's fraction is limited to less than +/−6%, and most preferably, Weber's fraction is limited to less than +/−2%, or minimized.

Although, aspects of the disclosed invention have been described above in terms of a single color frame of a three-color sequential-color projection system, which sequentially projects images data a bit at a time in contiguous segments arranged in order of magnitude, it should be apparent that the disclosed invention is applicable to virtually any display system, regardless of the ordering of the display bits or the method of generating a full-color image. The disclosed invention is applicable any time a display system with a minimum load time displays information using pulse-width modulation schemes.

Thus, although there has been disclosed to this point a particular embodiment for a display system having an increased brightness and a method thereof, it is not intended that such specific references be considered as limitations upon the scope of this invention except in-so-far as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims.

What is claimed is:

1. A method of allocating a single-color frame period to an n-bit intensity word, said n-bit intensity word comprised of an object bit, at least one less significant bit and at least one more significant bit, said method comprising the steps of:

> setting a portion of said single-color frame period to a bit period corresponding to said object bit at least equal to a minimum load time; and
>
> allocating a bit period corresponding to each of said at least one less significant bits and each of said at least one more significant bits, said bit periods corresponding to said less significant and said more significant bits having a binary relationship to said bit period of said object bit, said bit period corresponding to at least one bit of said intensity word other than the object bit being reduced from said binary relationship with said object bit such that a sum of said bit periods corresponding to said object bit and said less significant bits and said more significant bits and any blanking periods is no greater than said single-color frame period.

2. The method of claim 1, said allocating step resulting in a Weber's fraction of no more than 11% for all bit transitions for intensity word values above a value corresponding to said object bit.

3. The method of claim 1, said allocating step resulting in a Weber's fraction of no more than 6% for all bit transitions for intensity word values above a value corresponding to said object bit.

4. The method of claim 1, said allocating step resulting in a Weber's fraction of no more than 2% for all bit transitions above intensity word values above a value corresponding to said object bit.

5. The method of claim 1, said allocating step resulting in minimizing Weber's fraction for all bit transitions above intensity word values above a value corresponding to said object bit.

6. The method of claim 1, said allocating step comprising:

decreasing said bit period corresponding to at least one of said more significant bits.

7. The method of claim 1, said allocating step comprising:

decreasing all said bit periods corresponding to said more significant bits.

8. A display system comprising:

a display device having a minimum data load time;

a timing and control circuit for receiving image data words comprised of data bits including an object bit, and for providing said data bits to said display device for display during bit periods having a length, wherein said object bit has a bit period at least equal to said minimum data load time, said length of bit periods for said data bits of significance less than said object bit and of bit periods for said data bits of significance greater than said object bit having a binary relationship to said object bit, at least one bit period for said data bits of significance greater than or less than said object bit shortened from said binary relationship.

9. The display system of claim 8, said timing and control circuit providing said data bits for periods resulting in a Weber's fraction of no more than 11% for any bit transition of said image data words greater than a value of said object bit.

10. The display system of claim 8, said timing and control circuit providing said data bits for periods resulting in a Weber's fraction of no more than 6% for any bit transition of said image data words greater than a value of said object bit.

11. The display system of claim 8, said timing and control circuit providing said data bits for periods resulting in a Weber's fraction of no more than 2% for any bit transition of said image data words greater than a value of said object bit.

12. The display system of claim 8, said timing and control circuit providing said data bits for periods minimizig a Weber's fraction for any bit transition of said image data words greater than a value of said object bit.

13. The display system of claim 8, said timing and control circuit providing at least one said data bit of significance greater than said object bit for a period shortened from said binary relationship.

14. The display system of claim 8, said timing and control circuit providing all said data bits of significance greater than said object bit for a period shortened from said binary relationship.

* * * * *